United States Patent [19]

Earnest, Jr.

[11] Patent Number: 4,982,683

[45] Date of Patent: Jan. 8, 1991

[54] HAND-HELD TRAFFIC SIGNALING DEVICE

[76] Inventor: William D. Earnest, Jr., 712 Ardmore Rd., West Palm Beach, Fla. 33401

[21] Appl. No.: 416,880

[22] Filed: Oct. 4, 1989

[51] Int. Cl.[5] ..... G09F 21/02; G09F 7/22

[52] U.S. Cl. ..... 116/63 P; 40/536; 40/586

[58] Field of Search ..... 116/28 R, 63 P, 173, 116/174, 222, 223; 40/588, 593, 489, 530, 533, 536, 598, 586; 16/87.2

[56] References Cited

U.S. PATENT DOCUMENTS

| | | | |
|---|---|---|---|
| 1,709,041 | 4/1929 | Schutt | 40/536 |
| 2,097,805 | 11/1937 | Walsh | 40/586 |
| 2,194,010 | 3/1940 | Cooke | 40/536 |
| 2,612,548 | 9/1952 | Swanson | 340/908 |
| 2,933,841 | 4/1960 | Lawlor | 116/28 R |
| 3,775,887 | 12/1973 | Precourt | 40/603 |
| 3,800,730 | 4/1974 | Taylor | 116/200 |
| 4,005,537 | 2/1977 | von Camber et al. | 40/610 |
| 4,042,919 | 8/1977 | Patty | 340/321 |
| 4,062,139 | 12/1977 | Klosel | 40/533 |
| 4,208,820 | 6/1980 | Cole | 40/591 |
| 4,235,033 | 11/1980 | Eilers | 40/586 |
| 4,666,409 | 5/1987 | Sandberg | 434/365 |
| 4,756,556 | 7/1988 | Ader et al. | 281/15 A |
| 4,801,918 | 1/1989 | Buckingham et al. | 340/114 B |
| 4,864,962 | 9/1989 | Kuehl et al. | 116/174 |

FOREIGN PATENT DOCUMENTS

| | | | |
|---|---|---|---|
| 318718 | 9/1929 | United Kingdom | 40/530 |

*Primary Examiner*—Thomas S. Will
*Assistant Examiner*—W. Morris Worth
*Attorney, Agent, or Firm*—Eckert, Seamans, Cherin & Mellott

[57] ABSTRACT

A hand-held traffic signaling device includes at least two information panels and structure for connecting the panels about adjacent edges of the panels. The panels have front and back sides, which can each have indicia thereon for visually communicating information. The connecting structure is preferably adapted to circularly engage ajdacent side edge portions of the panels to allow the panels to rotate about an axis substantially parallel to the edges of the panels, such that a series of representations may be sequentially presented. Each of the panels preferably also has a holding structure adapted to permit the device to be carried or held in a signaling position with one hand.

12 Claims, 2 Drawing Sheets

HAND-HELD TRAFFIC SIGNALING DEVICE

BACKGROUND OF THE INVENTION

1. Field of the Invention

This invention relates generally to the field of visual signaling devices, and more particularly to signaling devices used to communicate traffic control information.

2. Description of the Prior Art

The use of visual signaling devices is necessary in those situations where audible signals are unable to reach the intended recipient of the information. This is a particularly acute problem in the control of vehicular traffic, where the driver is usually in an enclosed vehicle and sound signals are not readily audible.

Glare and adverse weather conditions can make visual traffic signals difficult to perceive. Several devices which have been used are extremely limited in their ability to convey the desired message to the recipient. This is particularly true of signal flags. These flags are usually orange in color, and are used by road workers in many states to communicate messages such as "stop", "proceed slowly", "proceed to the left", "proceed to the right", and the like. Recently, the United States Department of Transportation indicated in the Manual of Uniform Traffic Control Devices, at page 6F1, Section 6F2, Revision No. 4, that signal flags were no longer to be considered appropriate for traffic control.

Other prior signaling devices tend to be burdensome to the worker due to their excessive size and weight. Also, these devices are often not sufficiently durable to withstand road use. It would be desirable to have a visual signaling device which is light and compact, allowing for prolonged use by a worker. It would also be desirable to have a signaling device which may be carried and held in a signaling position by the use of only one hand. It would further be desirable to have a signaling device by which a multiplicity of visual representations which can be quickly and easily accessed to permit the worker to present varying messages as is necessary for a particular traffic situation.

SUMMARY OF THE INVENTION

It is an object of the invention to provide a hand-held, traffic signaling device which is light in weight.

It is another object of the invention to provide a hand-held, traffic signaling device which is compact.

It is still another object of the invention to provide a hand-held, traffic signaling device which is designed for use as a hand-held instrument.

It is yet another object of the invention to provide a traffic signaling device which can efficiently convey information to vehicle drivers.

It is another object of the invention to provide a convenient means of conveying several different visual messages to drivers corresponding to a particular traffic situation.

It is still another object of the invention to provide a traffic signaling device by which a multiplicity of visual representations can be sequentially conveyed to drivers.

These and other objects are accomplished by a hand-held, traffic signaling device having at least two information panels and a means of connection. Each of the at least two information panels preferably has information indicia on both the front and back sides. Each of the panels also has a grasping means which is adapted to permit the insertion of a hand such that all of the panels may be simultaneously grasped to facilitate manipulation by the worker. The invention has particular utility in traffic control situations, as at road construction sites where traffic must be directed through the construction.

The means of connection is preferably provided substantially at adjacent edges of the juxtaposed panels, so as to permit the panels to rotate circularly about an axis substantially parallel with the adjacent edges. A series of visual representations can thereby be sequentially accessed. As each panel is individually rotated, messages on the succeeding panel are conveyed to a recipient. The means of connection is preferably at least one circular fastener which is positioned through apertures provided adjacent to a common edge, preferably a top side edge, of the panels.

BRIEF DESCRIPTION OF THE DRAWINGS

There are shown in the drawings embodiments which are presently preferred, it being understood, however, that the invention is not limited to the precise arrangements and instrumentalities shown, wherein.

FIG. *5a* is a front elevation of a panel according to the invention.

FIG. *5b* is a rear elevation.

FIG. *6a* is a front elevation of an alternative panel.

FIG. *6b* is a rear elevation.

Figure 7:
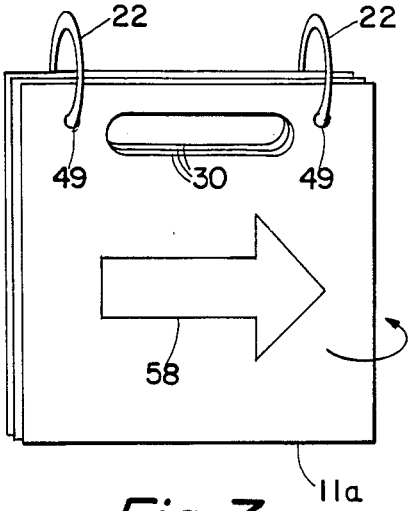

FIG. 7 is a perspective view of a hand-held signaling device in a first mode of operation.

Figure 8:
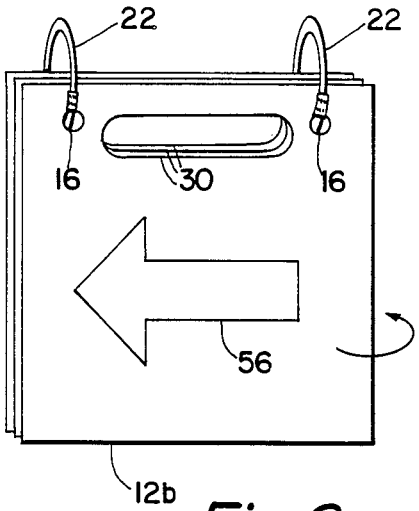

FIG. 8 is a perspective view in a second mode of operation.

DETAILED DESCRIPTION OF THE PREFERRED EMBODIMENTS

Figure 1:
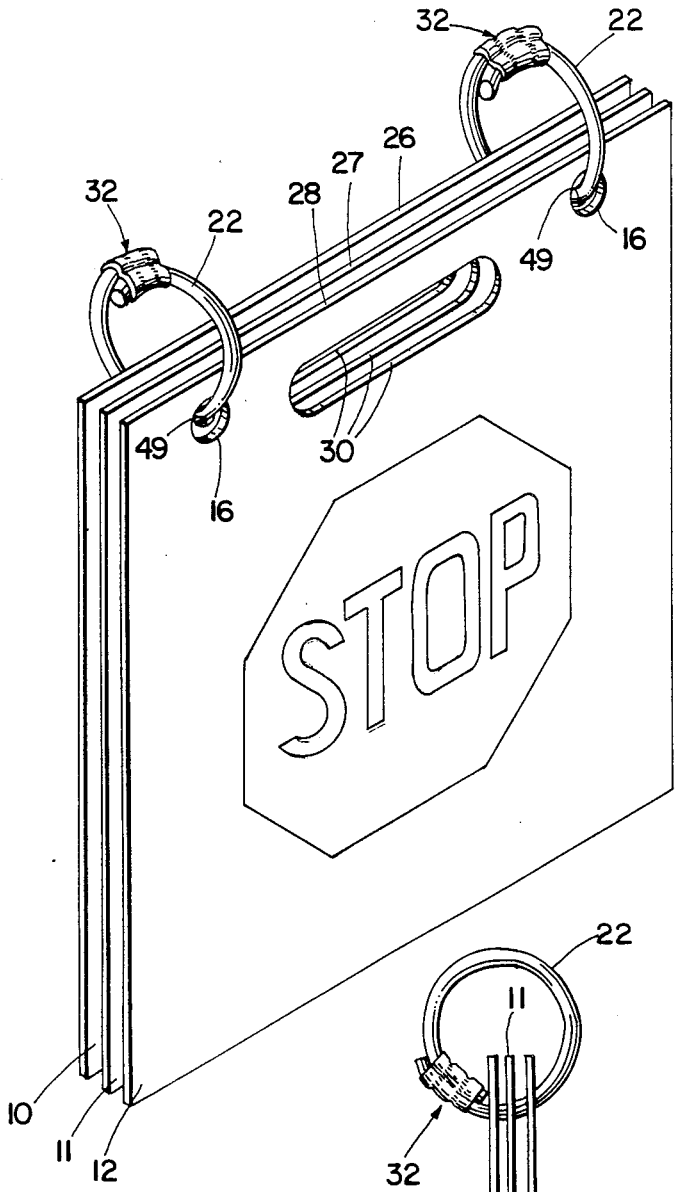
FIG. 1 is a perspective view of a hand-held traffic signaling device according to the invention.
Figure 2:
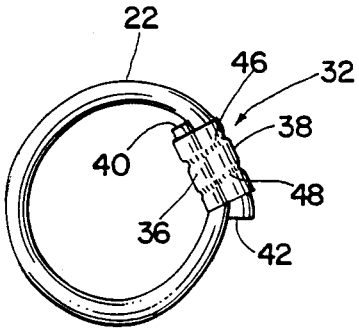
FIG. 2 is a side elevation of an attachment cable.
Figure 3:
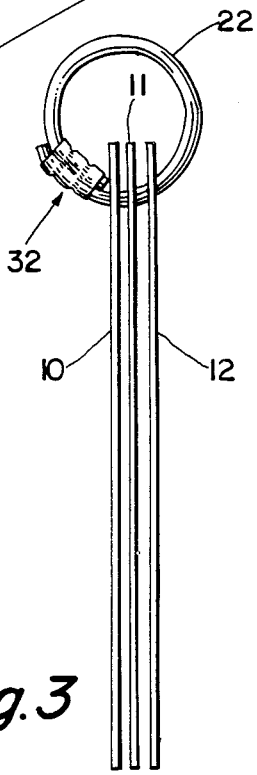
FIG. 3 is a side elevation of a hand-held traffic signaling device according to the invention.

A preferred hand-held, visual communicator according to the invention is shown in FIGS. 1–3. The invention has particular utility for communicating information to vehicle drivers. The traffic signaling device preferably includes two or more information panels 10, 11, 12 and a means for connecting the information panels. Each of the information panels 10–12 preferably has information indicia both of the front sides 11*a*, 12*a*, and the back sides 11*b*, 12*b* (FIGS. *5a,b* and *6a,b*). Each of the panels 10–12 preferably also has a grasping means which is adapted to permit the panels to be grasped and manipulated by the worker.

The connection means is preferably adapted to permit the panels to circularly rotate about an axis substantially parallel with one of the adjacent side edge portions of the panels. Apertures 16 are provided in the panel 12 and substantially align with apertures formed in the panels 10, 11 when the panels are juxtaposed. The connecting means preferably includes a circular fastener such as the cable 22 which is threaded through the apertures and circularly engages adjacent side edge portions of the panels, and preferably the top side edge portions 26, 27, 28 of the panels 10, 11, 12, respectively. The panels 10–12 can then be rotated about the circular fasteners 22 to present different sides, and thereby different information indicia, to the viewer.

The grasping means preferably comprises elongated handle openings 30 formed in each of the panels 10–12. The elongated handle openings 30 are provided in the same location in each panel such that the apertures align when the panels are juxtaposed. The hand of the user can thereby pass through the aligned openings 30 to grasp all of the panels and to permit a firm grip of the device.

Figure 4:
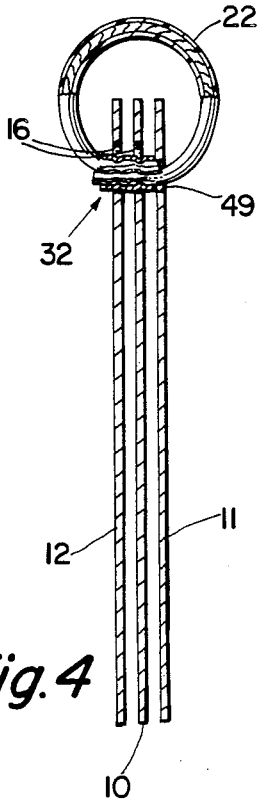
FIG. 4 is a side elevation similar to FIG. 3, partially in section to show internal features.

The fastening means 22 is preferably a sturdy cable of metal or plastic, and most preferably is constructed of metal coated with plastic. Ends of the cable can be fastened together by suitable means, preferably a fitting such as the swedge fitting 32 (FIGS. 2,4). The swedge fitting 32 is comprised of adjacent tubular channels 36, 38 into which the ends 40, 42 of the cable 22 are passed. The channels 36, 38 may then be crimped, such as at crimp locations 46, 48, to secure the ends 40, 42 within the swedge fitting 32.

It is possible that several panels, in addition to the three information panels 10–12 shown, could be incorporated into the device. The several panels may be utilized to display a multiplicity of sequential information. It is preferable to provide a means for quickly returning to an initial panel. This can be accomplished by providing one of the panels, in the present instance the panel 11, with small diameter openings 49, which are smaller in diameter than the openings 16. The remaining panels are provided with larger diameter openings 16. The larger diameter openings 16 are dimensioned to permit passage of the fitting 32. The smaller diameter openings 49 are dimensioned to permit passage of the cable 22, but not passage of the fitting 32. The panels can be quickly rotated about the fasteners 22 to bring the panel 11 to the forefront, and in abutting relationship to the fitting 32 (FIGS. 3–4).

Figure 5A:
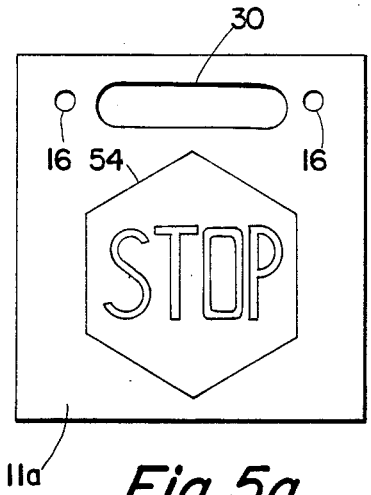
Figure 5B:
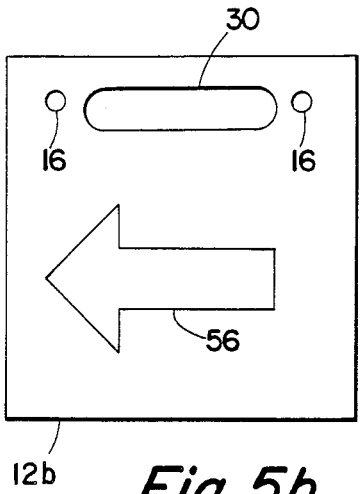
Figure 6A:
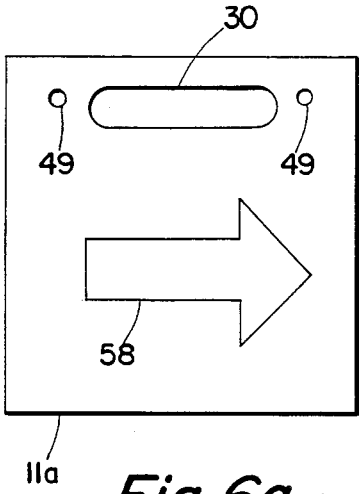
Figure 6B:
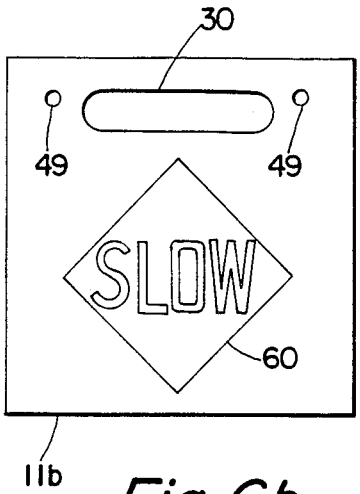

The indicia placed on the panels 10–12 can be varied. Indicia suitable for traffic control includes "stop" indicia 54 (FIG. 5*a*), "left turn" indicia 56 (FIG. 5*b*), "right turn" indicia 58 (FIG. 6*a*), and "slow" indicia 60 (FIG. 6*b*). The "left turn" and "right turn" indicia are preferably provided on adjacent sides of adjacent panels, such as the sides 12*b* and 11*a*, respectively, such that these signals may be positioned on the outermost sides of the device. In this manner, the direction of traffic may be changed simply by flipping the hand holding the device one way or the other (FIGS. 7–8).

The panels 10–12 can be manufactured in several sizes. It is preferable that the signs be dimensioned so as to permit lettering and indicia of at least six inches in height, in order to comply with current safety standards. The information panels accordingly are preferably approximately 21 inches high and 24 inches wide, although other dimensions are possible. The handle openings 30 can also be varied in dimension, but preferably are about 6 inches wide and about 2 inches high. The panels 10–12 can be made from suitable materials, but preferably are manufactured from a rigid, durable, light weight, and rust-resistant material such as plastic or aluminum. Lettering or other information indicia can be applied with a fluorescent or reflective material for improved visibility.

This invention can be embodied in other specific forms without departing from the spirit or essential attributes thereof, and accordingly, reference should be had to the following claims, rather than to the foregoing specification, as indicating the scope of the invention.

I claim:

1. A hand-held traffic signaling device, comprising:

at least two information panels, said at least two information panels each comprising front and back sides, at least one of said sides having information indicia thereon, said panels having a grasping means comprising handle openings in each of said panels dimensioned to permit a user to insert the hand through the openings and to simultaneously grasp all of said panels when said panels are juxtapositionally aligned; and, a means of connection, said means of connection being adapted to circularly engage adjacent side edge portions of said panels, and thereby to allow said panels to rotate about said means of connection to permit alternate display of said indicia on said panels.

2. The traffic signaling device of claim 1, wherein said means of connection comprises a closed-loop fastener positioned through fastening apertures in said panels, whereby said panels can rotate about said closed-loop fastener to present a multiplicity of information indicia on said panels to a viewer.

3. The traffic signaling device of claim 2, wherein said closed-loop fastener comprises a cable, said cable having juxtaposed ends fastened together.

4. The traffic signaling device of claim 3, wherein said ends of said cable are fastened by a fitting comprising adjacent tubular channels, said ends of said cable being positioned in said channels, said channels being crimped around said ends to engage said ends.

5. The traffic signaling device of claim 2, wherein said fastening apertures and said handle openings are provided along top edge portions of said panels.

6. The traffic signaling device of claim 1, wherein said panels are made from a rust-resistant, durable, light-weight material.

7. The traffic signaling device of claim 6, wherein said panels are made from the group consisting of plastics and aluminum.

8. A method for conveying visual information, particularly to vehicle drivers, comprising the steps of:

grasping a set of at least two juxtaposed information panels through aligned handle openings in the panels, said at least two juxtaposed information panels each comprising front and back faces, at least one of the faces having information indicia thereon, said panels being joined by a means of connection adapted to circularly engage adjacent side edge portions of said panels, and thereby to allow said panels to rotate about said means of connection, two of said set of juxtaposed panels being outwardly facing;

presenting information indicia on at least one of said outwardly-facing panels to a viewer; and, rotating at least one of said outwardly-facing panels about said connection means to present additional panel faces and information indicia to the viewer.

9. The method of claim 8, wherein said step of presenting indicia on said outwardly-facing panels to a viewer further comprises the step of rotating the hand to present indicia on each of said outwardly facing panels to the viewer.

10. The method of claim 9, wherein said indicia on said outwardly-facing panels are arrows indicating "left turn" and "right turn", said step of presenting including the step of changing the orientation of said device to quickly indicate a change in the direction of said traffic.

11. The method of claim 8, wherein said connection means is a circular fastener including a stop, one of said panels has smaller diameter apertures dimensioned to prevent the passage of the stop, and the remaining panels have apertures dimensioned to permit the passage of the stop, said method including the step of periodically returning the panels to an initial position by rotating the panels bearing the larger diameter opening about the circular fastener to return the panel bearing the smaller diameter openings to the forefront.

12. The traffic signaling device of claim 1, wherein said connection means is a circular fastener including a stop, said panels having apertures for receiving said circular fastener, one of said panels having smaller diameter apertures dimensioned to prevent the passage of the stop, and the remaining panels having apertures dimensioned to permit the passage of the stop, whereby said panels can be rotated about the circular fastener and periodically returned to an initial position by rotating the panels bearing the larger diameter openings about the circular fastener to return the panel bearing the smaller diameter openings to the forefront.

* * * * *